US008905207B2

(12) United States Patent
Hamilton

(10) Patent No.: US 8,905,207 B2
(45) Date of Patent: Dec. 9, 2014

(54) PERSONAL SEATED RESTING SUPPORT

(76) Inventor: Gordon Blackwood Hamilton, Suffolk (GB)

( * ) Notice: Subject to any disclaimer, the term of this patent is extended or adjusted under 35 U.S.C. 154(b) by 509 days.

(21) Appl. No.: 13/258,739

(22) PCT Filed: Mar. 26, 2010

(86) PCT No.: PCT/GB2010/050520

§ 371 (c)(1),
(2), (4) Date: Sep. 28, 2011

(87) PCT Pub. No.: WO2010/112901

PCT Pub. Date: Oct. 7, 2010

(65) Prior Publication Data

US 2012/0012431 A1 Jan. 19, 2012

(30) Foreign Application Priority Data

Mar. 28, 2009 (GB) ..... 0905382.8

(51) Int. Cl.

| | |
|---|---|
| ***A45C 5/14*** | (2006.01) |
| ***A45C 13/28*** | (2006.01) |
| ***A45F 4/02*** | (2006.01) |
| ***A45F 4/00*** | (2006.01) |
| ***A45C 13/26*** | (2006.01) |
| ***A45F 3/04*** | (2006.01) |
| ***A47C 16/00*** | (2006.01) |

(52) U.S. Cl.

CPC . *A45F 3/04* (2013.01); *A45C 13/28* (2013.01); *A45F 4/02* (2013.01); *A45F 4/00* (2013.01); *A45C 13/262* (2013.01); *A47C 16/00* (2013.01)

USPC ..... 190/18 A; 190/1; 190/2; 190/8; 190/11; 190/115; 190/18 R

(58) Field of Classification Search

USPC ..... 190/1–13 R, 18 A, 119, 18 R

See application file for complete search history.

(56) References Cited

U.S. PATENT DOCUMENTS 4,228,877 A * 10/1980 Cothary ..... 190/18 A
4,790,416 A * 12/1988 Baker ..... 190/11

(Continued)

FOREIGN PATENT DOCUMENTS

| | | |
|---|---|---|
| FR | 2818881 | 7/2002 |
| WO | 9803096 | 1/1998 |
| WO | 2007071977 | 6/2007 |

OTHER PUBLICATIONS

International Search Report for PCT/GB2010/050520 EPO, Jun. 28, 2010.

(Continued)

*Primary Examiner* — Tri Mai

(74) *Attorney, Agent, or Firm* — Bourque and Associates, PA

(57) ABSTRACT

The present invention relates to an item of luggage (101) incorporating a collapsed resting support (125) which when erected may be used to support portions of a resting person (55) in a forwards leaning seated position. The item of luggage comprises an external casing (102) that extends across a plurality of sides of the item of luggage, and a personal resting support (125) for supporting a resting seated person's upper torso, the personal resting support being removeably affixable to a side (103) of the casing when not in use for resting support of a seated person. The resting support includes a main supporting section (126) for supporting a seated user's upper torso in a forwards leaning seated position, and at least two supporting legs (117, 118; 146) for supporting the main supporting section and which in use extend downwardly from the main supporting section. The item of luggage (101) comprises at least one ground engaging rolling means (109, 110) by which the item of luggage may be wheeled along the ground when being moved about and a handle (114) by which the item of luggage may be pulled to wheel the item of luggage along the ground. The handle (114) is joined to the casing (102) through one or more of the legs (117, 118) when the personal resting support (125) is affixed to the side (103) of the casing.

19 Claims, 7 Drawing Sheets

(56) References Cited

U.S. PATENT DOCUMENTS

| | | | | |
|---|---|---|---|---|
| 5,529,322 | A | 6/1996 | Barton | |
| 5,713,439 | A * | 2/1998 | Zionts et al. | 190/102 |
| 6,196,560 | B1 | 3/2001 | Ohlsson | |
| 6,832,670 | B2 * | 12/2004 | Wolters et al. | 190/18 A |
| 7,364,129 | B1 | 4/2008 | Levari, Jr. | |
| 2002/0017766 | A1 | 2/2002 | Thompson | |
| 2004/0262865 | A1 | 12/2004 | Sigler | |
| 2005/0098402 | A1 | 5/2005 | Cohen | |
| 2007/0145700 | A1 | 6/2007 | Ambrose et al. | |
| 2007/0159781 | A1 | 7/2007 | Zbikowski | |

OTHER PUBLICATIONS

Written Opinion of the International Searching Authority in PCT/GB2010/050520 EPO.

Search Report in GB0905382.8, UK Intellectual Property Office, Jul. 17, 2009.

* cited by examiner

PERSONAL SEATED RESTING SUPPORT

BACKGROUND a. Field of the Invention

The present invention relates to an item of luggage incorporating a collapsed resting support which when erected may be used to support portions of a resting person in a forwards leaning seated position.

b. Related Art

A travelling passenger, for example on an aircraft, may need to sleep during a long journey. In economy class seating accommodation, a person may be forced to sleep sitting almost upright in a seat. The key distinction of such non-horizontal sleeping is that some body elements are required to support each other, wholly or partially. A number of problems result from this. Additional weight stresses are transmitted through joints and musculature, for example, muscles and the spine transmit most of the weight of the head and arms to the upper torso and thence from the upper torso to the lower torso and thighs. Additional contact pressure is created between some body elements and their supporting surfaces due to transmitted weight from adjacent body elements. For example, the lower torso (hips and buttocks) and thighs carry the extra weight of the upper torso, head and arms which is translated into increased contact pressure between them and the supporting seat base.

Prior art solutions to the problem of resting during a journey mostly involve various contortions adopted by the seated traveller to alleviate the stresses and strains, for example: leaning the head, upper torso, and arms against the seat back and head rests in various ways; leaning the head, upper torso, and arms against the seat arms; leaning the head, upper torso and arms on one's own thighs and knees; or leaning the head and/or shoulders and/or arms on the seat in front or some other support standing on the floor spaced in front of a seated individual.

All of these methods involve weight transfer between body elements, caused by counterbalancing the elements of support, for example: upper torso to head; upper torso to arms; upper torso to lower torso, lower torso to seat, etc. This creates associated joint and musculature stresses. Consequently these methods do not provide the benefit of an ideal horizontal sleeping position in which each body portion or element bears only its own weight so that stresses transmitted through joints and musculature are avoided and contact pressure between each body element and its supporting surface (the bed) is minimised.

Patent document WO 2007/071977 A2 therefore discloses a lightweight, portable, personal seated resting support that directly supports of the upper torso (waist to head) of a seated user in a resting position in which weight transfer stresses between body elements are largely eliminated, thereby allowing each body element to support only its own weight. This device therefore eliminates or significantly reduces weight transfer from the upper torso to other body elements such as head, arms, lower torso and thighs.

This prior art resting support device has at least two separate supporting legs, including a rear supporting leg adapted to engage with a seat surface on which the user is seated, and a longer front leg adapted to engage with the floor. These legs can be collapsed against a main supporting section when not in use. The resting support device is also lightweight and sufficiently compact when collapsed so that the device can be incorporated into other useful artefacts of the traveller. For example a suitcase may have a recess in a side in which the collapsed support is stowed, with the external surface of the resting support device when so stowed forming the external surface of that part of the suitcase. This side of the suitcase can then be detached to form the resting support.

While this arrangement is convenient, a number of problems remain. The recess in the side of suitcase diminishes the storage space inside the suitcase, while the addition of the resting support device also adds to the weight of the suitcase. The panel also needs to be secured within the recess by means of a plurality of key operated latches spaced around the periphery of the recess in the suitcase side. This increases the mechanical complexity of the arrangement and can also make it difficult or time-consuming to release the resting support device when needed.

It is therefore an object of the invention to provide a more convenient resting support device incorporated into an item of luggage.

SUMMARY OF THE INVENTION

According to the invention, there is provided an item of luggage, comprising an external casing, said casing extending across a plurality of sides of the item of luggage, and a personal resting support for supporting a resting seated person's upper torso, wherein:

the personal resting support is removeably affixed to a side of the casing when not in use for resting support of said seated person and is removeable from said casing when in use to provide said resting support of said seated person, the personal resting support comprising a main supporting section and at least two supporting legs for supporting the main supporting section independently of said casing when the personal resting support is removed from said casing, said at least two legs in use extending downwardly from the main supporting section such that the main supporting section extends upwards and away from of a seated person facing the personal resting support for supporting said seated person's upper torso in a forwards leaning seated position;

the item of luggage comprises at least one ground engaging rolling means by which the item of luggage may be wheeled along the ground when being moved about;

the item of luggage comprises, when the personal resting support is affixed to said side of the casing, a handle by which the item of luggage may be pulled to wheel the item of luggage along the ground, said handle being joined to the casing through one or more of said legs when the personal resting support is affixed to said side of the casing.

The user may therefore affix the personal resting support to the casing when the item of luggage is to be moved about. The handle is preferably provided on an extending member so that height of the handle can be set to a convenient level for the user to wheel the item about by pulling on the handle. When the user wishes to rest, the personal resting support is removed from the casing and then set up, as explained blow, to enable the seated user to rest on the main supporting section.

In preferred embodiments of the invention, the handle is part of at least one of the supporting legs.

The handle may comprise a means for extending the length of the handle so that the handle may in use be gripped at different heights as the item of luggage is pulled along the ground. The means for extending the length of the handle then also serves, in use, to extend the length of at least one of the supporting legs when the personal resting support is separated from the casing to provide the resting support of a seated person.

In preferred embodiments of the invention, at least one of the legs is a front leg adapted for engaging with a floor in front of said seated person, and at least one of the legs is a rear leg adapted for engaging with a seat on which said person is seated. The main supporting section then slopes upwardly from the rear supporting leg to the front supporting leg so that the user may rest his or her upper torso on the upward sloping main supporting section.

The casing may be a rigid casing, semi-rigid casing or a flexible casing, for example a casing with flexible fabric sides.

The handle is preferably provided on the floor engaging leg.

Also in preferred embodiments of the invention, the main supporting section has a frame with a central recess. The front and rear legs are pivotably attached at respective front and rear portions of the main supporting section, such that both said front and rear legs may pivot into the recess when the personal resting support is to be affixed to the casing. Collapsing the personal resting support in this way when not in use helps to minimise the volume of the resting support so that the size of the item of luggage is not unduly increased when the resting support is affixed to the luggage casing.

The personal resting support may comprise a "T" shaped member having a stem portion and at the end of the stem portion a bar portion. The rear leg is then formed from the stem portion with the end of the stem portion opposite the bar portion being pivotably attached to the frame. The bar portion then serves as a foot for engaging with a seat on which said person is seated.

In preferred embodiments of the invention, the front leg has a pair of elongate supporting members, each of these elongate members being at one end pivotably attached to the frame and at the opposite end being attached to each other by the handle. This arrangement provides several advantages. The pair of elongate members, which are preferably parallel with each other, help to brace the handle against twisting forces. The extent of the handle can also provide lateral stabilisation of the personal resting support when the handle serves as a foot for the leg to which the handle is joined.

The leg by which the handle is joined to the casing is preferably movable between a retracted orientation and an extended orientation relative to the main supporting section so that the handle may be retracted and extended relative to the casing when the personal resting support is affixed to the casing.

This relative movement of the leg may be an extension or a retraction in the length so that the leg may move between the retracted orientation and the extended orientation.

Additionally or alternatively, this relative movement of the leg may involve a sliding movement of the leg with respect to the casing so that the leg may move between the retracted orientation and the extended orientation.

Apart from allowing the height adjustment of the handle, this movement permits the handle to become flush with the casing when the leg by which the handle is connected to the casing is moved to the retracted position. Although it may not be possible to grip the handle to wheel the luggage about when the handle is so retracted, this configuration is convenient when the item of luggage is not in use or is stowed away.

In preferred embodiment of the invention, the leg by which the handle is connected to the casing is pivotable with respect to the main supporting section. This is so that this leg may be pivoted to extend away from the main supporting section to support the main supporting section when in use as a resting support, and also so that this leg may be pivoted towards the main supporting section so that the personal resting support can lie flat against the casing when affixed to the casing.

The leg by which the handle is connected to the casing is most preferably extendable so that the height and/or angle of the main supporting section relative to the seated user may be adjusted to suit said user. The handle also most preferably is linked to a catch mechanism which is used in two different ways. First, this mechanism may be used to secure the extension of this leg at one of a plurality different lengths both when the personal resting support is affixed to the casing, in order to adjust the height of the handle. Second, the mechanism may be used to adjust the length of this leg when the personal resting support is to be used for resting support of said seated person, in order to adjust the height and/or angle of the main supporting section.

The handle may serve as a foot for the associated leg when the leg is used to support the main supporting section in order to support a seated person's upper torso in a forwards leaning seated position.

The handle may also have a press-button release mechanism for releasing the catch to permit the length of the leg to be extended or retracted when the personal resting support is to be used for resting support of the seated user. This release mechanism may be provided on an upwards facing portion of the handle when serving as a foot for said leg. This arrangement allows a user to release the catch by using his or her foot to press on the press-button. This is particularly helpful in confined spaces, such as an airline cabin.

The item of luggage may include a removable covering for the main supporting section of the personal resting support, in which case, the casing may include a compartment dedicated for storing this covering when removed from the main supporting section.

As in the acknowledged prior art, a generally upwards sloping angle of the main supporting section together with at least one rear leg that engages with a seat on which the user is seated are important features of the invention, as these features ensure the stable positioning of the personal resting support during use, as well as providing a natural and comfortable resting position. The or each of the rear legs position a lower region of the main supporting section between a lower portion of the upper torso and the person's lap, while all or substantially all of the weight on the lower portion of the main supporting section is transmitted downwards onto the seating surface on which the user is seated rather than onto the resting person's lap. The positioning of the lower region of the main supporting surface in the constrained space between the lower portion of the upper torso and the person's lap steadies the resting support from tilting forwards under the force imparted by the weight of the resting person on the resting support, which will generally be directed downwards and forwards. There is therefore no need for the resting support to have a heavy or bulky base or for any type of cantilevered supporting arrangement or rigid fixing with the seat or floor in order to prevent forwards tipping of the resting support and to position and hold the resting support in a stable position during use.

A significant benefit of the invention is that by directly supporting the upper torso, problems associated with body elements such as the head, arms, lower torso, and thighs bearing weight from other body elements is eliminated or greatly reduced.

BRIEF DESCRIPTION OF THE DRAWINGS

The invention will now be further described, by way of example only, and with reference to the accompanying drawings, in which.

DETAILED DESCRIPTION

Figures 1, 2, 3, 4:
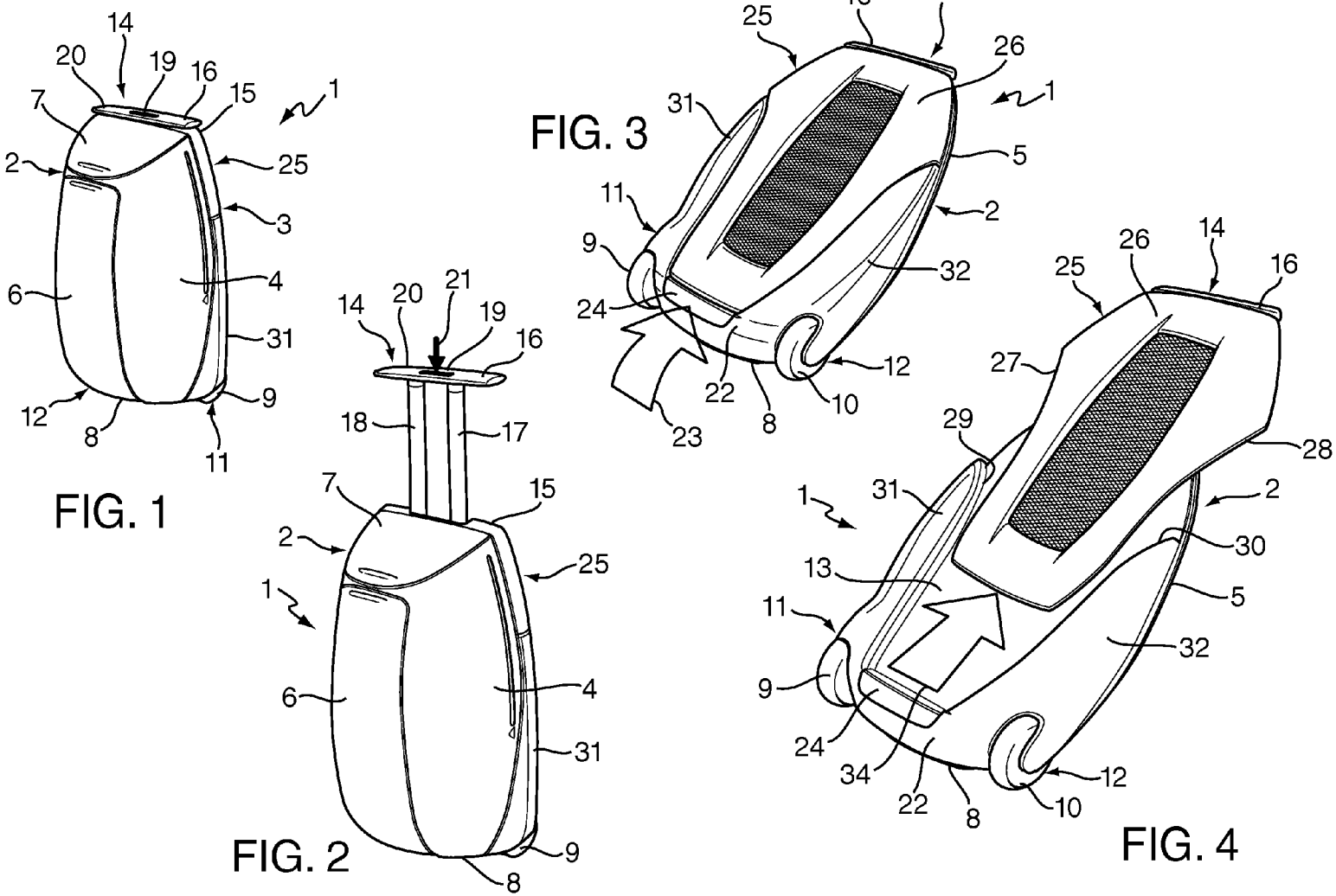
FIG. 1 shows an item of luggage according to a first embodiment of the invention, comprising a wheeled casing and affixed on one side of the casing a collapsed personal resting support included a retracted handle with an outwardly facing release button.
FIG. 2 shows the item of luggage of FIG. 1 with the handle extended from the portion of the personal resting support directly affixed to the casing.
FIG. 3 shows how a release button is pressed in order to release the personal resting support from the casing of FIG. 1.
FIG. 4 shows how the personal resting support of FIG. 3, when released, slides out from a pair of overhanging features on left and right sides of one side of the casing.

FIGS. 1 to 4 show various views of an item of luggage 1, comprising an external casing 2 that extends across a plurality of sides of the item of luggage, including a front side 3, left and right sides 4, 5, a back side 6, a top side 7 and a bottom side 8.

The casing 2 supports a left wheel 9 and a right wheel 10 at left and right lower front corners 11, 12 of the casing. An extendable handle 14 is provided along the upper front edge 15 of the casing. The handle has a grip portion 16 that extends in a horizontal direction, when the casing is upright and which crosses the top of a pair of parallel elongate supporting members 17, 18 that are extendable from the casing after a release button 19 on a top surface 20 of the grip portion 16 has been pressed 21. The elongate members 17, 18 may be lockable at a number of different extended positions, with the lock mechanism also being released by means of the button 19. The user may therefore extend the handle 14 to a desired height comfortable for pulling the casing 2 along the ground.

FIGS. 3 and 4 show how on a lower front edge 22 of the front side of the casing 2 there is a release button 24, which when pressed 23 disengages a catch (not shown) to release a personal seated resting support 25 from the casing 2. The resting support 25 has a main body portion 26, with left and right side edges 27, 28. Lower portions of the left and right side edges 27, 28 slot into left and right channels 29, 30 that extend partly along the length of left and right side edges 31, 32 of the front side 3 of the casing. When the release button 24 is manually disengaged 23, the resting support 25 is slid upwards 34 out the channels 29, 30. When the resting support 25 is to be re-engaged with the casing 2, the resting support 25 is slid downwards so that the left and right edges 27, 28 of the main body portion 26 slot into the left and right channels 29, 30 until the catch is engaged to hold the resting support securely in place with the casing 2.

Figure 6:
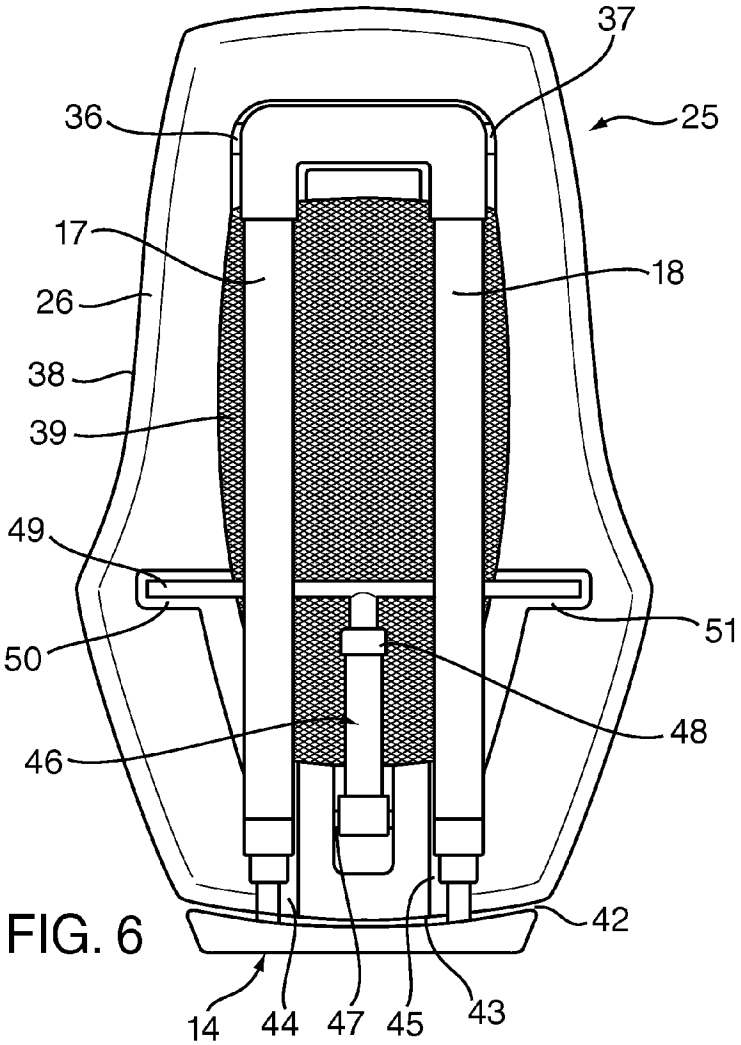
FIGS. 5 and 6 show, respectively, opposite front and back views of the personal resting support of FIG. 4 when released from the casing.
Figure 5:
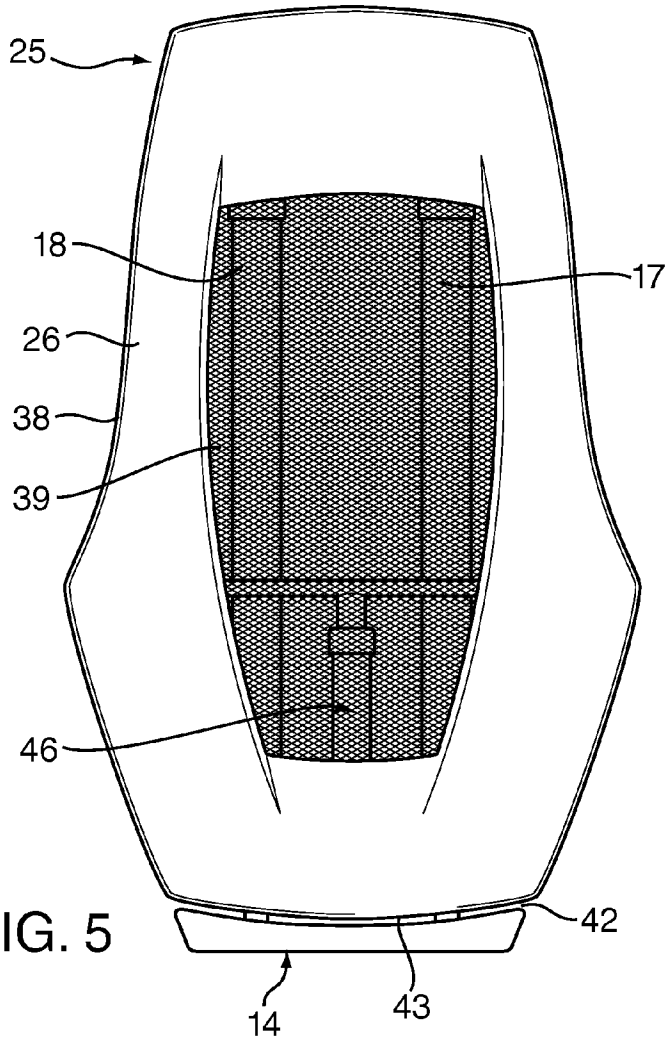

FIGS. 5 and 6 show front and back side views of the personal resting support 25 when fully removed from the casing 2. The main body portion 26 has an elongate and roughly rectangular frame 38, a central portion of which is spanned by a mesh fabric 39. As can be seen from FIG. 4, the channels 29, 30 are at left and right sides of a recess 13 in the front side 3 of the casing 2, so that when the resting support 25 is engaged with the casing, the frame forms flush fit with adjacent exposed surfaces of the casing.

The pair of elongate supporting members 17, 18 is telescopically extendable and pivotably connected at left and right pivot mounts 36, 37 at a front end 40 of the frame 38. As shown in FIG. 6, when pivoted to lie flat with the frame 38, the supporting members 17, 18 lie within a recess 36 defined by the frame which extends substantially around the supporting members, except where these extend to the handle 14, which is separate by a small gap 42 from a rear end 43 of the frame, where the elongate supports lie within a pair of parallel semi-cylindrical channels 44, 45 formed in the frame 38. As will be explained in more detail below, when the supporting members 17, 18 are rotated to an angle of about 60° with respect to the main body portion and extended, the elongate supports serve as a front leg with the handle 14 serving as a foot to support a forwards portion of the main supporting section 26.

The resting support 25 also has a second elongate supporting member 46 that is pivotably connected at a pivot mount 47 to the main supporting portion 26 near the rear end 43 of the frame 38. The length of the second supporting member is also telescopically adjustable, and can be set by loosening or tightening a bushing 48. The second supporting member 46 terminates at a bar 49 that extends transversely at the free end of the supporting member with the bar and supporting member forming a T-shape. When collapsed into the recess 36, the bar lies behind the elongate supporting members 17, 18 which thereby retain the second supporting member 46 in the recess. The bar 49 extends transversely beyond inner edges of the frame 38 which therefore has a pair of half-cylindrical channels 50, 51 so that the second supporting member is more completely recessed within the recess 36. As will be explained in more detail below, when the second supporting member is rotated to be approximately parallel with the rotated and extended elongate supporting members 17, 18, the second supporting member 46 serves as a rear leg with the bar 49 serving as a foot to support a rearwards portion of the main supporting section 26.

Figure 9:
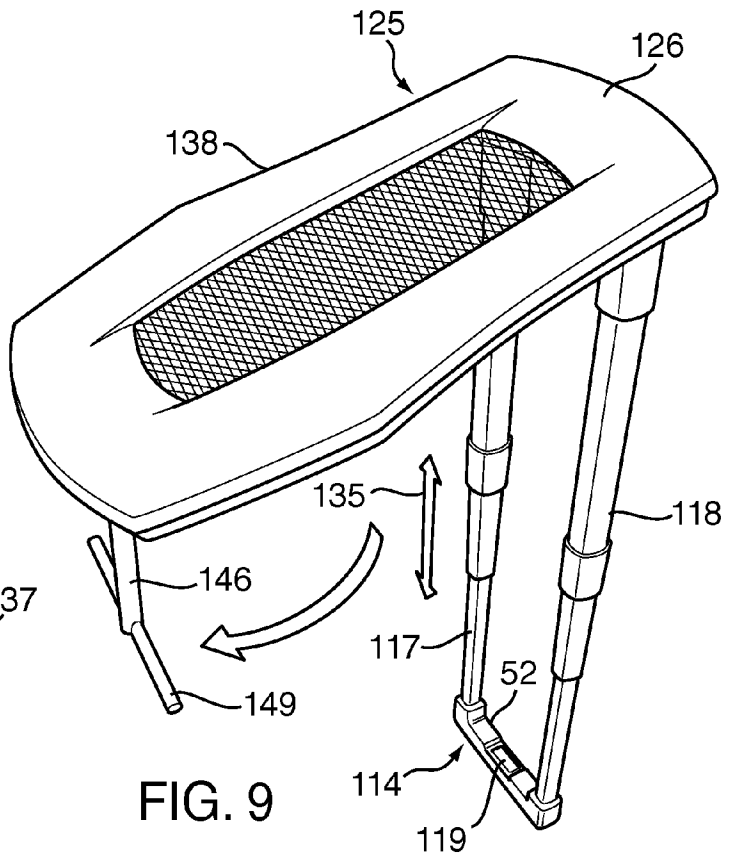
FIG. 9 shows how front and rear legs of the personal resting support of FIGS. 7 and 8 are pivoted and, in the case of the front leg, extended into position for supporting a seated user of the support in a resting position.
Figure 7:
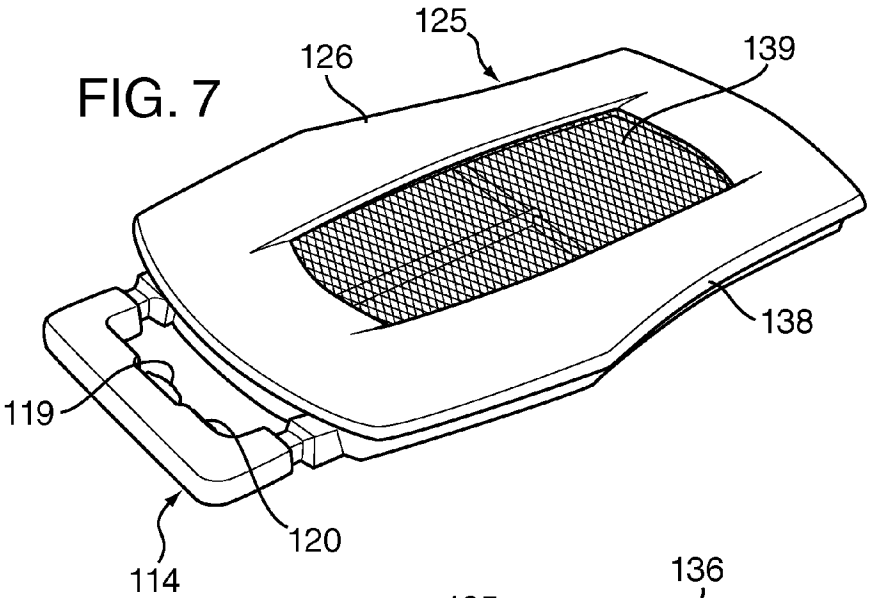
FIGS. 7 and 8 show, respectively, opposite front and back views of a second embodiment of a personal resting support, similar to the first embodiment but having a handle with an inwardly facing release button.
Figure 8:
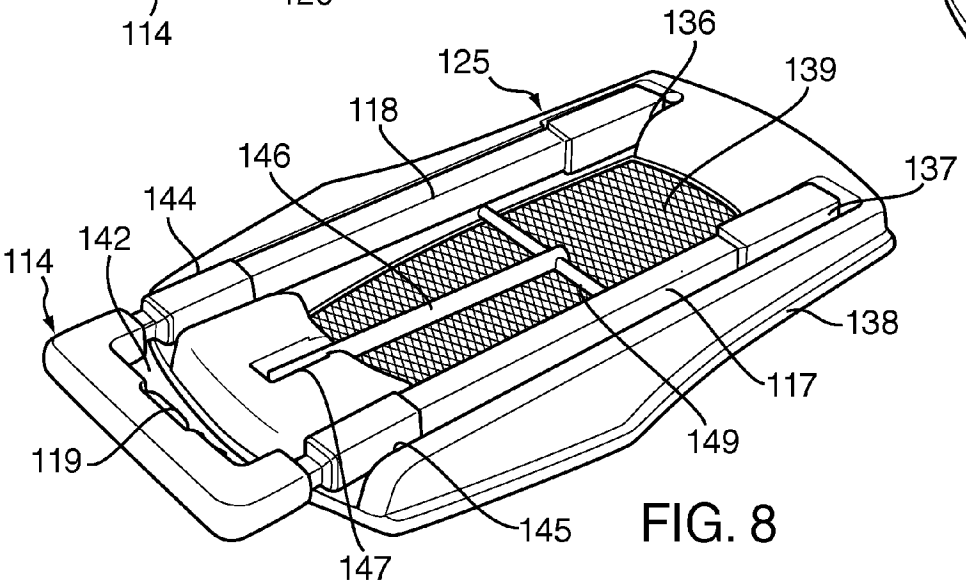
Figure 10:
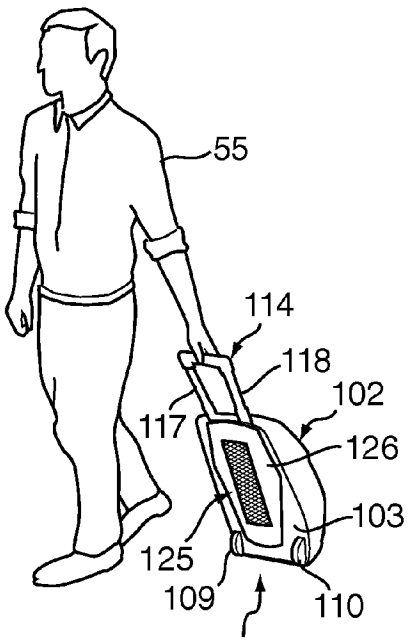
FIG. 10 shows a user pulling an item of luggage incorporating the personal resting support of FIGS. 7 and 8, with the front leg of the support and handle extended.

FIGS. 7-9 show various views of a second embodiment of a personal resting support 125, in which features similar to that 25 of the first embodiment are indicated by reference numerals incremented by 100. The main difference in the second embodiment is that the handle 114 has an inwardly facing release button 119 on a lower surface 52 of the handle. As with the first embodiment, the handle is supported at the end of a pair of elongate supporting members 117, 118, which as shown in FIG. 9 are telescopically extendable 135, and pivotably connected at left and right pivot mounts 137, 138 to a main body portion 126 of the resting support 125.

A second supporting member 146 having an end bar 149 is also pivotably connected near a rear end 143 of a surrounding frame 138, but is not telescopically extendable. FIG. 9 shows the configuration of the main supporting section 126 and supporting members 117, 118, 146 when rotated and extended for supporting the upper torso of a seated person in a forwards leaning seated position.

FIGS. 10-19 show how the second embodiment of the personal seated resting support is used, when integrated with a casing 102 to form a second embodiment of an item of luggage 101. The size of the casing 102 may vary depending on how the user 55 wishes to travel. For example, if the luggage complies with size restrictions for aircraft carry-on luggage, then the user may wheel the item of luggage 101 into an aircraft cabin 60, as shown in FIGS. 10-13.

When the item of luggage 101 is being moved about on its wheels 109, 110, the front leg formed by the elongate supporting members 117, 118 by which the handle 114 is joined to the casing 102, extends away from the casing to elevate the handle with respect to the casing, so that the user can easily pull the item of luggage.

Figure 17:
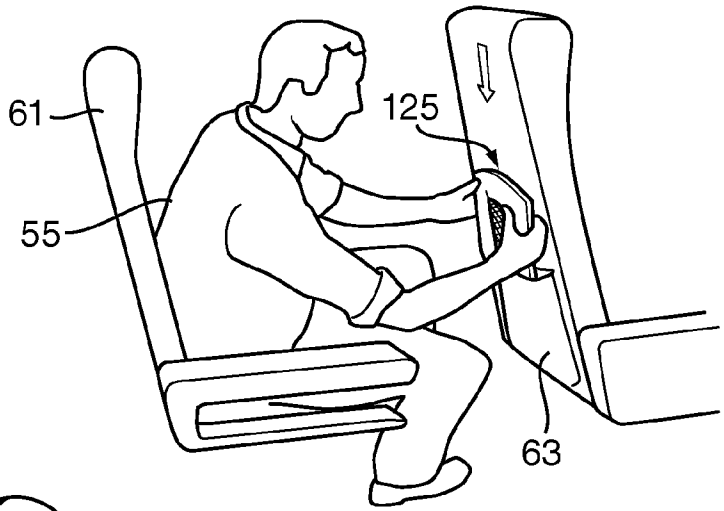
FIG. 17 shows how the personal seated resting support can be stored in a seat back pocket in front of the seated user.

When the user 55 reaches his seat 61 in the aircraft cabin 60, he will retract the handle 114 and supports 117, 118 and then may remove the personal resting support 125 from the recess 113 in the casing 102. The item of luggage may then be stowed away in an overhead storage bin 62. The resting support will remain collapsed in a substantially flat configuration until needed, and when not in use may be stored in a seat-back pocket 63 as shown in FIG. 17. As explained above, in this folded flat orientation, the rear leg 146 is retained within the frame recess 113 by the front leg 117, 118, when this is folded into the recess, through an interference of the bar portion 149 of the rear leg with the elongate supporting members 117, 118 of the front leg.

Figure 14:
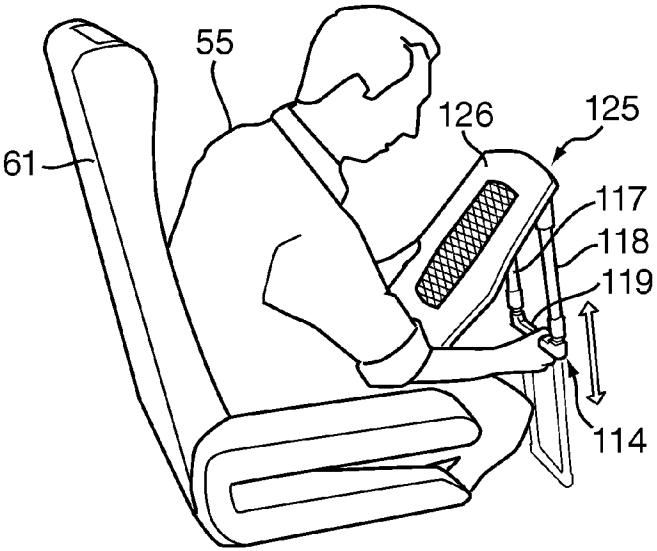

When the user 55 wishes to use the resting support 125, then as shown in FIG. 14, the user first rotates the front leg formed by the elongate supporting members 117, 118 downward and away from the main supporting section 126, and then presses the release button 119 on the handle 114 to telescopically extend the front leg 117, 118. The rear leg formed by the second supporting member 146 is then free to be rotated downwards and away from the main supporting section 126.

The front foot formed by the handle 114 is then allowed to rest on the floor of the cabin and the rear foot formed by the bar 149 is allowed to rest on the seat squab 65. The second elongate support 146 extends downwardly between the seated user's thighs so that the user's thighs rest on the bar 149 in order to hold the seated resting support 125 in place. It should be noted that the rear leg 146 cannot rotate beyond a limit so that when the user's weight rests on the upwards sloping main supporting section 126, the forwards pressure on the resting support is restrained by the rear leg and foot which are prevented from rotating or moving forwards by seated person's weight on the bar 149 which is thereby pressed into the seat squab 65.

This arrangement also provides some bracing against any side-to-side forces, but in an aircraft this will usually be a much smaller force than forces in the forwards and backwards directions.

Figure 16:
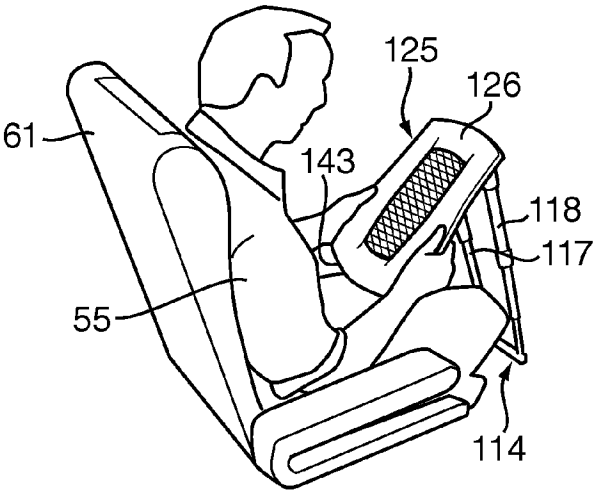
FIGS. 14 to 16 show the steps taken by the user to assemble the personal resting support when seated in the aircraft cabin.
Figure 15:
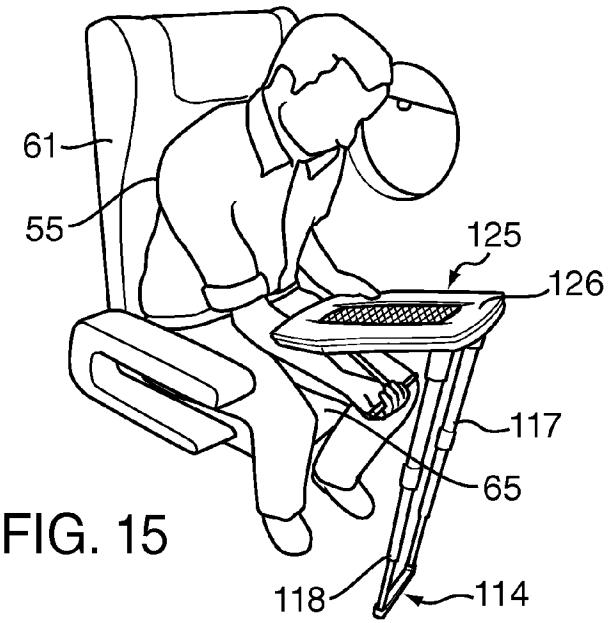

When correctly positioned, the upwards sloping angle of the main supporting section, both for this embodiment 126 and the previous embodiment 26, should be less than about 60° to minimise resolved force components in the plane of the main supporting section 9, but greater than about 10° so to avoid stresses on the lower back of the user from being bent double. Most preferably, the angle should be between 40° and 15°. As shown in FIG. 16, this range of angles also helps position the lower edge 143 of the main supporting section 126 so that there is a small gap between the seated person's lap or thighs and the upper torso. This orientation is important because any tendency for the resting support 125 to tip forwards owing to the forwards components of the resolved forces will be further resisted by the contact or near contact between the main supporting section 126 and the person's upper torso or lap in the vicinity of this gap.

Figure 11:
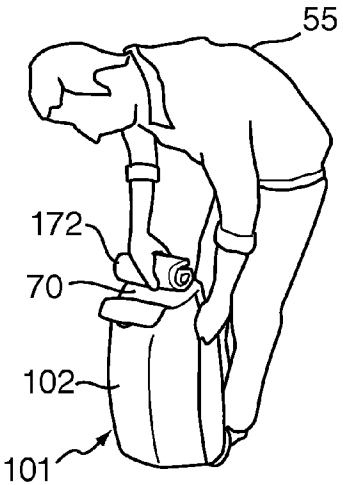
FIG. 11 shows a user opening a top compartment of the item of luggage of FIG. 10 to obtain access to a cushion, having also retracted the front leg of the support and handle.
Figure 12:
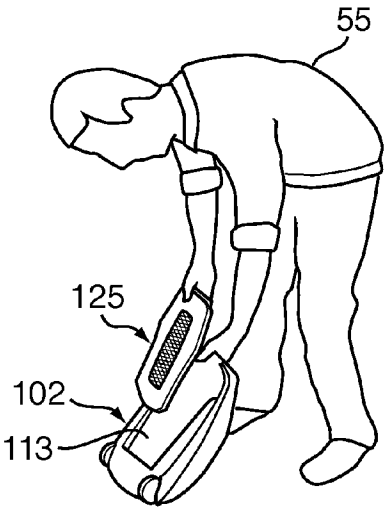
FIG. 12 shows how a user can activate a release button within the compartment to release the personal resting support from the luggage casing.
Figure 13:
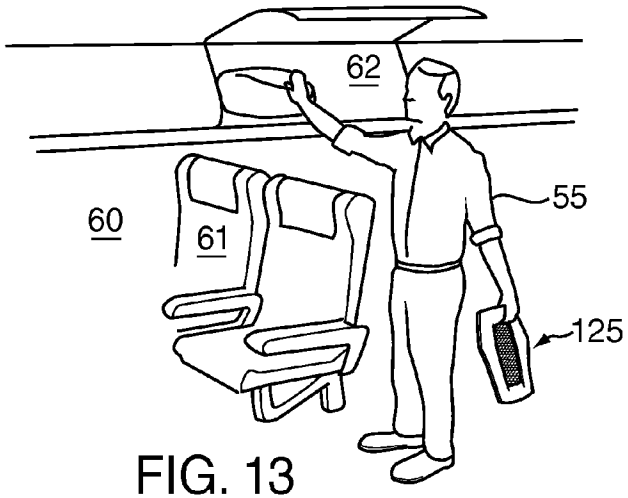
FIG. 13 shows the user stowing the luggage casing in an overhead bin of an aircraft cabin.
Figure 18:
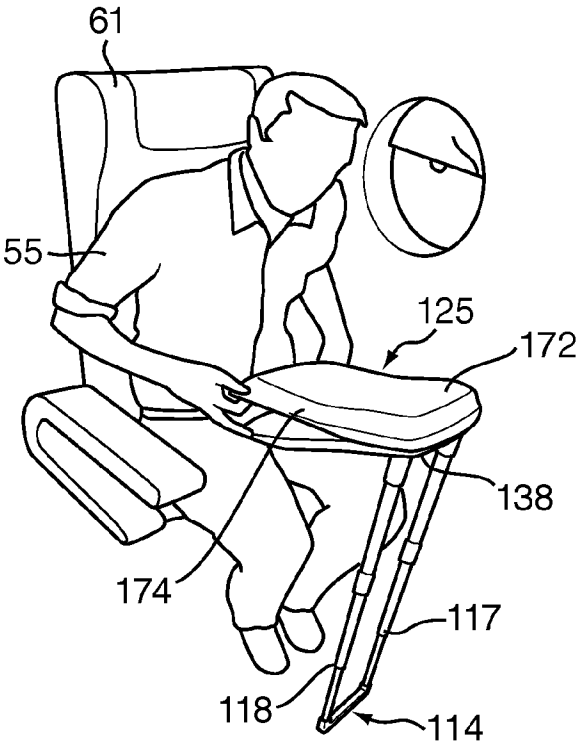
FIG. 18 shows how the cushion of FIG. 11 is fixed to the front surface of the resting support to provide padding.

Optionally, the casing may as shown in FIG. 11 have a compartment 70 in which padding 172 for the main supporting section 126 is stored. As shown in FIG. 18, this padding can be fitted around the frame 138, for example by means of an elasticised overhanging edge 174 of the padding. The padding, together with the mesh fabric 136 spanning the area inside the frame 138, which may also be elasticised, provides a comfortable resting surface for the user 55.

Figure 19:
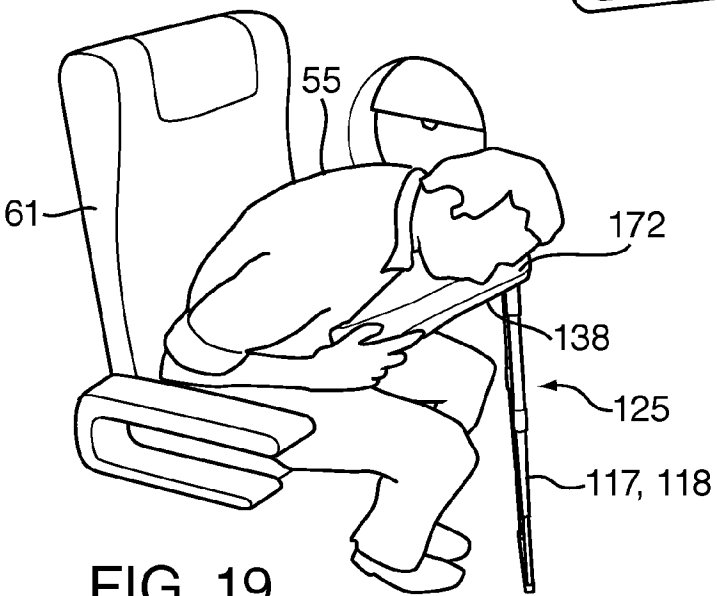
FIG. 19 shows how a user rests his upper torso on the personal seated resting support in order to rest or sleep while in a seated position.

As can be seen from FIG. 19, the resting support 125 directly supports the weight of the upper torso and head of a seated user 1. Depending on the size of the support, this may also provide direct support for the user's arms. As explained above, the resting support 125 is stably supported which is to say it will stand on its own supports and does not require the users body to counterbalance it.

Figure 21:
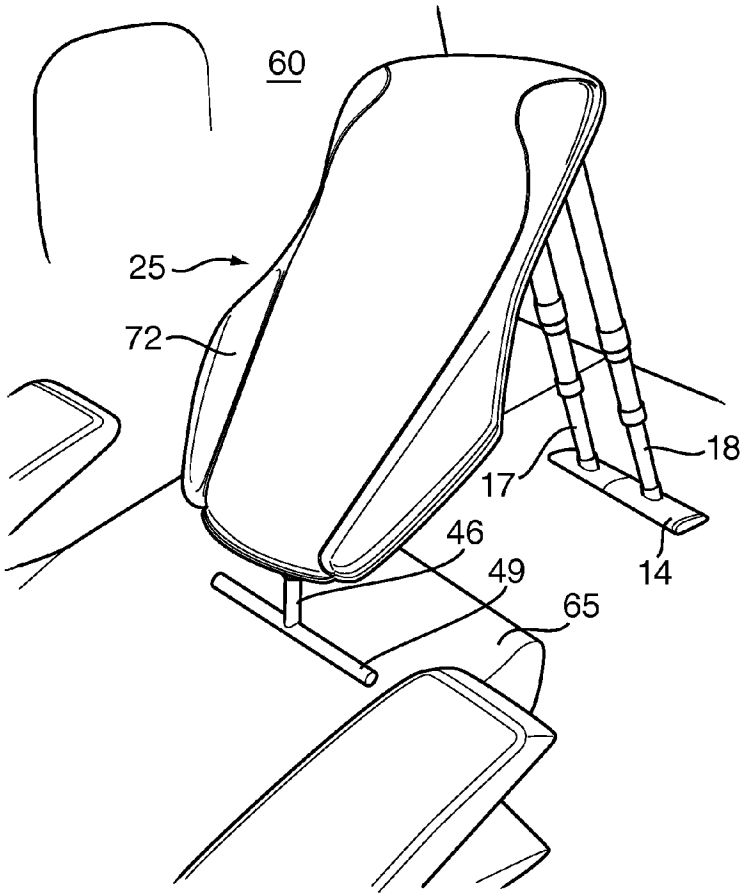
FIG. 21 is view of the personal seated resting support of FIG. 20 after covering with a cushion to provide padding.
Figure 20:
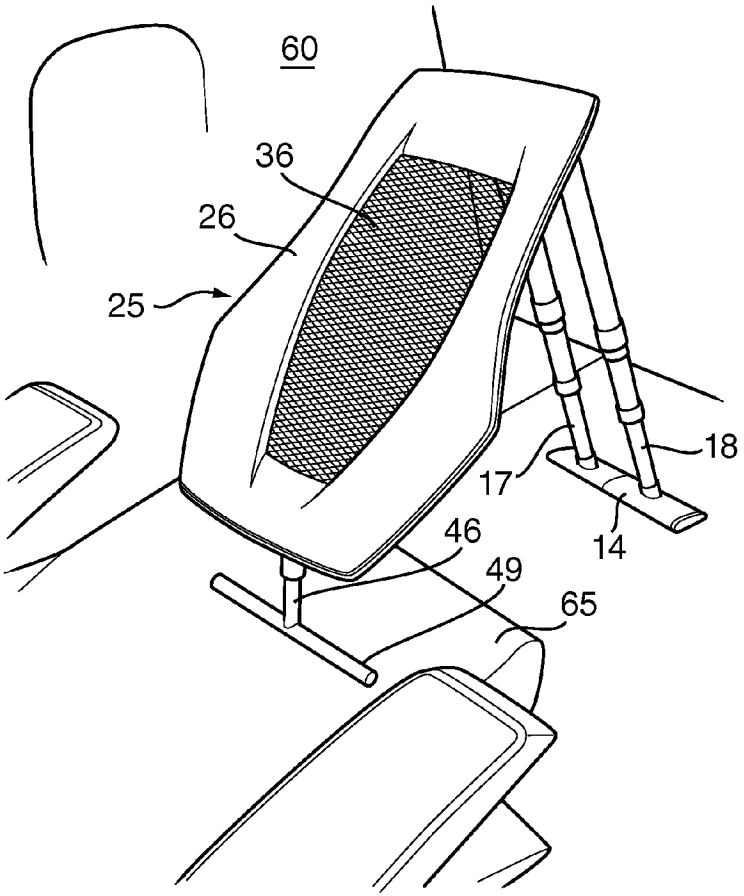
FIG. 20 shows how the front an back legs of the personal resting support of FIG. 3 engage with, respectively, the floor and seat where the user is to be seated.

FIGS. 20 and 21 show the first embodiment of the resting support 25 assembled for use in the aircraft cabin 60, both with and without removable padding 72 fitted to the main supporting section 26. The use of this resting support is the same as that described above in connection with the second embodiment. An advantage of the first embodiment is that the handle 14 does provide additional lateral support, as this extends left and right beyond the elongate supporting members 17, 18, and additionally the user may place one of his feet on these extending parts of the foot in order to stabilise the resting support. An advantage of the second embodiment is that a the upwards facing button 119 may be pressed by the user to release and collapse the telescopic supporting members 117, 118 when it is time to put the resting support 125 away. Although not illustrated, these features of the upward facing button 119 and laterally extending foot may, of course, be combined.

The material of the supporting sections, 13, 26, 113 126 may be man-made or natural, rigid, pliant or deformable. For example, these sections could be constructed using lightweight metal, or injection moulded plastic, or canvas with an internal metal or plastic framework, or using an inflatable membrane, or a combination of these. The use of a mesh fabric inside a surrounding frame helps to reduce weight. The supporting sections 13, 26, 113, 126 may be adorned with padding or cushions to facilitate comfort or, in a simpler form, left bare to allow the users to provide their own form of cushions. The pliancy or deformable nature of the device materials, or the padding or cushions, may contribute to the final (in use) profile of the supporting sections, for example convex, concave, or contoured.

The relative angles between the main supporting section 26, 126 and the front leg 17, 18 and between the main supporting section 26, 126 and rear leg 46, are preferably securable at desired orientations so that the legs to not rotate once a person places the resting weight of his torso on the main supporting section. This may be achieved, for example, by providing a sufficient amount of rotational friction at the pivot mounts 36, 37, 47 or by means of a latch mechanism (not shown) which engaged at predetermined angles.

The resting support 25, 125 described above provides the traveller with a stably supported supporting section(s) that substantially supports the weight of his/her upper torso (waist to head) and thereby eliminates or significantly reduces weight transfer from the upper torso to other body elements such as head, arms, lower torso and thighs.

The resting support device described above is lightweight and portable, especially as this is combined with a rolling item of luggage, and may be adjusted for the user's upper torso and preferred resting angle as well as for use with any kind of seat.

It is appreciated that certain features of the invention, which are, for clarity, described or illustrated in the context of separate embodiments, may also be provided in combination in a single embodiment.

It is to be recognized that various alterations, modifications, and/or additions may be introduced into the constructions and arrangements of parts described above without departing from the spirit or scope of the present invention, as defined by the appended claims.

The invention claimed is:

1. An item of luggage, comprising an external casing, said casing extending across a plurality of sides of the item of luggage, and a personal resting support for supporting a seated person's upper torso;

wherein said casing includes a personal resting support recess, configured for allowing the personal resting support to be removeably inserted into the recess in a side of the casing when not in use a resting support of said seated person, and for allowing said personal resting support to be removable from said casing when in use to provide said resting support of said seated person's upper torso;

wherein the personal resting support comprises a main supporting section having a front portion and a rear portion and at least two supporting legs for supporting the main supporting section independently of said casing when the personal resting support is removed from said casing, wherein at least one of said at least two supporting legs is a front leg coupled to said front portion of said main supporting section and at least one of said at least two supporting legs is a rear leg coupled to said rear portion of said main supporting section, said at least two supporting legs configured, in use, for extending downwardly from the main supporting section such that the main supporting section extends upwards and away from a seated person facing the personal resting support, for supporting said seated person's upper torso in a forwards leaning seated position;

wherein the item of luggage comprises at least one ground engaging rolling means configured for allowing the item of luggage to be wheeled along the ground when being moved about; and wherein the personal resting support includes a handle coupled to at least one of said at least two supporting legs, the handle thereby being connected to the casing when the personal resting support is affixed to said side of the casing, said handle configured for allowing the item of luggage to be pulled to wheel the item of luggage along the ground when being moved about.

2. The item of luggage as claimed in claim 1, in which said at least one of said at least two supporting legs leg to which the handle is coupled to said personal resting support is configured to extend away from the casing when the personal resting support is affixed to said side of the casing, to elevate the handle with respect to the casing.

3. The item of luggage as claimed in claim 1, in which said at least one of said at least two supporting legs to which is coupled said handle comprises a means for extending the length of the at least one of said at least two supporting legs so that the coupled handle may, in use, be gripped at different heights as the item of luggage is pulled along the ground, said means for extending the length of the handle also serving, in use, to extend the length of at least one of said supporting legs when the personal resting support is separated from the casing to provide said resting support of said seated person.

4. The item of luggage as claimed in claim 1, in which said front leg is configured for engaging with a floor in front of said seated person, and said rear leg is configured for engaging with a seat on which said person is seated, said handle being provided on said front, floor engaging leg.

5. The item of luggage as claimed in claim 4, in which:

the main supporting section has a frame with a central recess; and the front and rear legs are pivotably attached at respective said front and rear portions of the main supporting section, such that both said front and rear legs may pivot into the recess when the personal resting support is affixed to the casing.

6. The item of luggage as claimed in claim 5, in which:

the rear leg of the personal resting support comprises a "T" shaped leg member having a stem portion and at the end of the stem portion a bar portion;

wherein the end of the stem portion opposite the bar portion is pivotably attached to the frame; and wherein the bar portion serves as a foot for engaging with a seat on which said person is seated.

7. The item of luggage as claimed in claim 6, in which the front leg comprises a pair of elongate supporting front leg members, each of said supporting front leg members being at one end pivotably attached to the frame and at an opposite end being attached to each other by the handle.

8. The item of luggage as claimed in claim 7, in which the rear leg is retained within said recess by the front leg when in said recess through an interference of the bar portion of said rear leg with said elongate front leg supporting members.

9. The item of luggage as claimed in claim 7, in which said elongate members are parallel to one another.

10. The item of luggage as claimed in claim 9, in which the front leg by which the handle is connected to the main supporting section is configured to be movable between a retracted orientation and an extended orientation relative to the main supporting section so that the handle may be retracted and extended relative to the casing when the personal resting support is affixed to the casing.

11. The item of luggage as claimed in claim 10, in which the length of the front leg by which the handle is joined to the main supporting section is configured to be extendable and retractable so that the leg may move between the retracted orientation and the extended orientation.

12. The item of luggage as claimed in claim 10, in which the front leg by which the handle is connected to the main supporting section is slideable with respect to the casing so that the front leg may move between the retracted orientation and the extended orientation.

13. The item of luggage as claimed in claim 12, in which the handle becomes flush with the casing when the leg by which the handle is connected to the main supporting section is moved to the retracted position.

14. The item of luggage as claimed in claim 13, in which the front leg by which the handle is connected to the mail supporting section is configured to be pivotable with respect to the main supporting section so that:

said front leg may be pivoted to extend away from the main supporting section to support the main supporting section when in use as a resting support; and said front leg may be pivoted towards the main supporting section so that the personal resting support can lie flat against the casing when affixed to the casing.

15. The item of luggage as claimed in claim 1, in which:

the at least one of said at least two supporting legs by which the handle is connected to the main supporting section is extendable so that the height and/or angle of the main supporting section relative to the seated user may be adjusted to suit said user; and wherein the handle is coupled to a catch mechanism for securing the extension of said at least one of said at least two supporting legs at one of a plurality different lengths both when the personal resting support is affixed to the casing and when the personal resting support is to be used for resting support of said seated person.

16. The item of luggage as claimed in claim 15, in which the handle serves as a foot for said at least one of said at least two supporting legs when the leg is used to support the main supporting section in order to support a seated person's upper torso in a forwards leaning seated position.

17. The item of luggage as claimed in claim 16, in which the handle includes a press-button release mechanism for releasing the catch to permit the length of the at least one of said at least two supporting legs to be extended or retracted when the personal resting support is to be used for resting support of said seated person, said release mechanism being provided on an upwards facing portion of the handle when serving as a foot for said leg.

18. The item of luggage as claimed in claim 1, in which the item of luggage includes a removable covering for the main supporting section of the personal resting support and wherein the casing includes a compartment dedicated for storing said covering when removed from the main supporting section.

19. An item of luggage, comprising an external casing, said casing extending across a plurality of sides of the item of luggage, and a personal resting support for supporting a seated person's upper torso;

wherein said casing includes a personal resting support recess, configured for allowing the personal resting support to be removeably inserted into the recess in a side of the casing when not in use as a resting support of said seated person, and for allowing said personal resting support to be removable from said casing when in use to provide said resting support of said seated person's upper torso;

wherein the personal resting support comprises a main supporting section having a front portion and a rear portion and at least two supporting legs for supporting the main supporting section independently of said casing when the personal resting support is removed from said casing, wherein at least one of said at least two supporting legs is a front leg coupled to said front portion of said main supporting section and at least one of said at least two supporting legs is a rear leg coupled to said rear portion of said main supporting section, said at least two supporting legs configured, in use, for extending downwardly from the main supporting section such that the main supporting section extends upwards and away from a seated person facing the personal resting support, for supporting said seated person's upper torso in a forwards leaning seated position;

wherein the item of luggage comprises at least one ground engaging rolling means configured to allowing the item of luggage to be wheeled along the ground when being moved about; and wherein the personal resting support includes a handle coupled to at least one of said at least two supporting legs, the handle thereby being connected to the casing when the personal resting support is affixed to said side of the casing, said handle configured for allowing the item of luggage to be pulled to wheel the item of luggage along the ground when being moved about; wherein said front leg is configured for engaging with a floor in front of said seated person, and said rear leg is configured for engaging with a seat on which said person is seated, said handle being provided on said front, floor engaging leg.

* * * * *